US007887110B2

(12) United States Patent
Cheng et al.

(10) Patent No.: US 7,887,110 B2
(45) Date of Patent: Feb. 15, 2011

(54) AUTOMATIC DETACHING STRUCTURE FOR A HOOK DEVICE

(75) Inventors: Li-Hsin Cheng, Kaohsiung Hsien (TW); Pak-Hing Lee, Kaohsiung Hsien (TW); Li-Min Sung, Kaohsiung Hsien (TW); Cheng-Chung Cheng, Kaohsiung Hsien (TW)

(73) Assignee: Fooyin University, Kaohsiung Hsien (TW)

( * ) Notice: Subject to any disclaimer, the term of this patent is extended or adjusted under 35 U.S.C. 154(b) by 471 days.

(21) Appl. No.: 12/111,378

(22) Filed: Apr. 29, 2008

(65) Prior Publication Data

US 2009/0267371 A1 Oct. 29, 2009

(51) Int. Cl.
*B66C 1/36* (2006.01)

(52) U.S. Cl. ..... 294/82.17; 294/82.23; 294/82.3; 294/905; 294/82.21

(58) Field of Classification Search ..... 294/82.17, 294/82.21, 82.23, 82.3, 905; 24/599.1, 599.2, 24/599.6

See application file for complete search history.

(56) References Cited

U.S. PATENT DOCUMENTS

| | | | | |
|---|---|---|---|---|
| 4,077,661 | A * | 3/1978 | Inahashi | 294/82.3 |
| 4,195,872 | A * | 4/1980 | Skaalen et al. | 294/82.19 |
| 5,108,139 | A * | 4/1992 | Leech | 294/82.17 |
| 5,609,378 | A * | 3/1997 | Bowers et al. | 294/82.3 |
| 5,636,888 | A * | 6/1997 | Kiser et al. | 294/82.3 |

* cited by examiner

*Primary Examiner*—Paul T Chin
(74) *Attorney, Agent, or Firm*—Rosenberg, Klein & Lee

(57) ABSTRACT

An automatic detaching structure for a hook device includes a hook, a power unit, a tongue plate and an off-hook member. The power unit comprises a motor which is remote-controlled. The motor has a shaft. A first transmission transforming mechanism and a first gear are provided on the shaft. The first transmission transforming mechanism and the first gear mesh with a second transmission transforming mechanism and a second gear, respectively, to link a rotating lever and a transmission lever. The rotating lever links the tongue plate in an open status, while transmission wheels on the transmission lever pull the off-hook member to detach a rope of a cargo from the hook.

4 Claims, 7 Drawing Sheets

AUTOMATIC DETACHING STRUCTURE FOR A HOOK DEVICE

BACKGROUND OF THE INVENTION

1. Field of the Invention

The present invention relates to an automatic detaching structure for a hook device, and more particularly to one that uses a remote controller to control a motor to link a transmission lever and transmission wheels to tighten an off-hook unit to hang a cargo and to detach the cargo automatically.

2. Description of the Prior Art

A conventional hook device requires an operator to operate a tongue to hook and to release a cargo from a hook manually In order to prevent the cargo from detaching from the hook accidentally, a tongue plate is adapted to close an opening of the hook. The tongue plate is controlled by a spring to open and to close the opening. However, it is required to move the tongue plate to off hook the cargo. A hook device with a remote-controlled tongue plate was taught in Taiwanese Publication No. 200736153, which utilizes a motor to operate the tongue plate, however, this design still requires the user to off hook the rope of the cargo manually.

SUMMARY OF THE INVENTION

In view of the above shortcomings, the present invention provides an automatic detaching structure for a hook device comprising a hook, a power unit, a tongue plate and an off-hook member, wherein said hook having a hook end and an opening and said tongue plate corresponding to said opening of said hook; and characterized by:

said power unit being disposed on said hook and comprising a motor, a rotating lever, a transmission lever, and a pair of transmission wheels at respective ends of said transmission lever;

said tongue plate being secured to said rotating lever of said power unit and driven by said rotating lever to close or to open said opening of said hook; and said off-hook member having a first end and a second end, said first end being fixed to said transmission wheel, said second end being fixed to said hook end of said hook.

Preferably, said power unit is provided with a fixture to be secured to said hook, said motor of said power unit being remote-controlled, said motor comprising a shaft and a receiver, said receiver receiving a signal sent from a remote controller, a first transmission transforming mechanism and a first gear being provided on said shaft, a second transmission transforming mechanism being provided on said rotating lever, a second gear being provided on said transmission lever, said second transmission transforming mechanism meshing with said first transmission transforming mechanism, said second gear meshing with said first gear, said off-hook member being either of a rope and a chain, said off-hook member being provided with a sleeve and a screw penetrating said sleeve, said power unit being operated to pull said off-hook member to change its shape from arc to straight, said power unit further comprising a power supply unit.

Preferably, said power supply unit is a battery.

Alternatively, said power supply unit is an outlet power supply.

It is the primary object of the present invention to provide an automatic detaching structure for a hook device, which provides a motor to link a tongue plate to close an opening of a hook, preventing a cargo from dropping accidentally and unloading the cargo automatically.

It is another object of the present invention to provide an automatic detaching structure for a hook device, which can be controlled remotely to prevent an operator from getting hurt.

It is a further object of the present invention to provide an automatic detaching structure for a hook device, which saves labor and is cost-effective.

It is still a further object of the present invention to provide an automatic detaching structure for a hook device, which may use the original hook without the need of replacing a new one.

DETAILED DESCRIPTION OF THE PREFERRED EMBODIMENT

Figure 1:
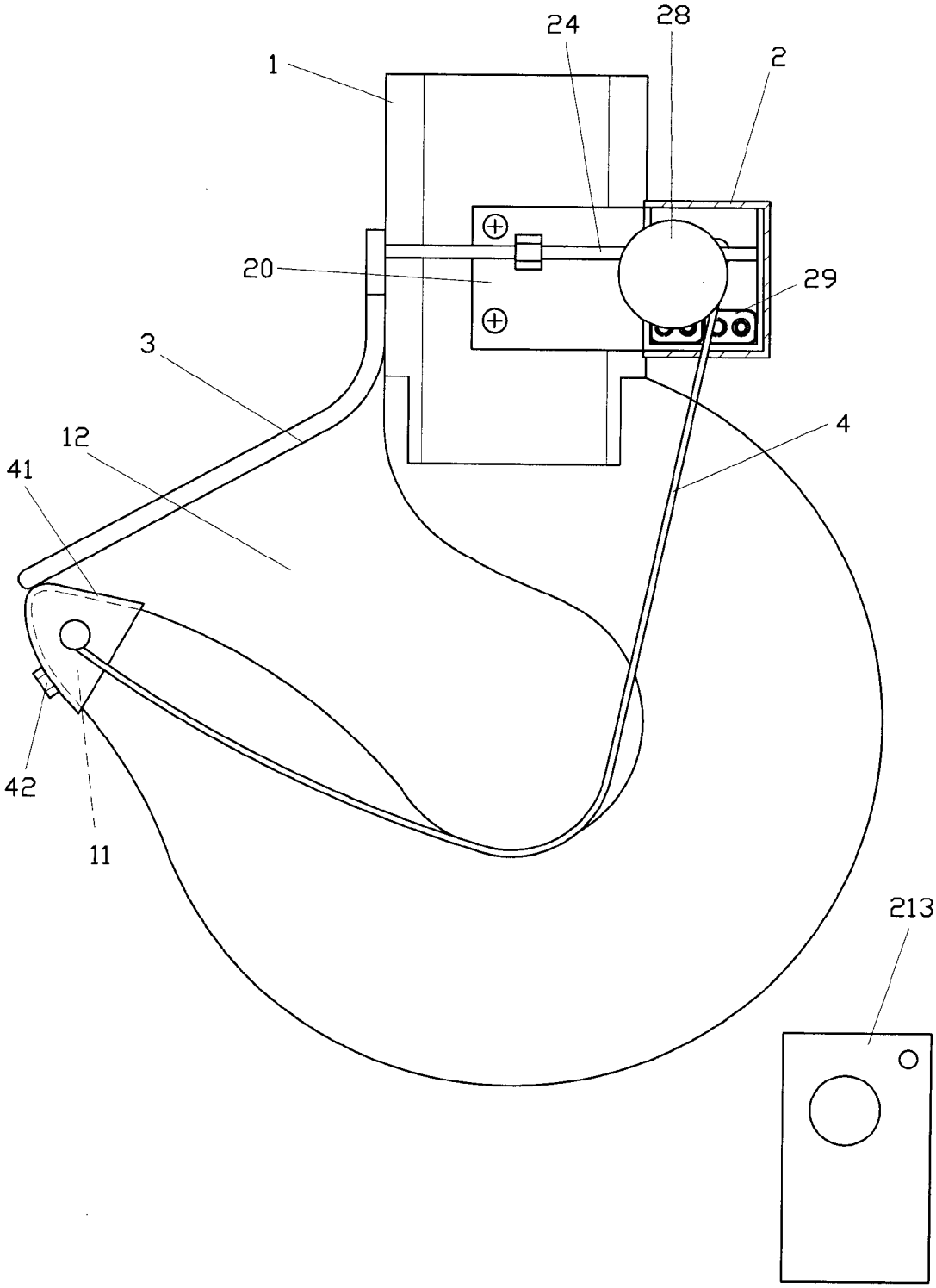
FIG. 1 is a side view of the present invention.
Figure 2:
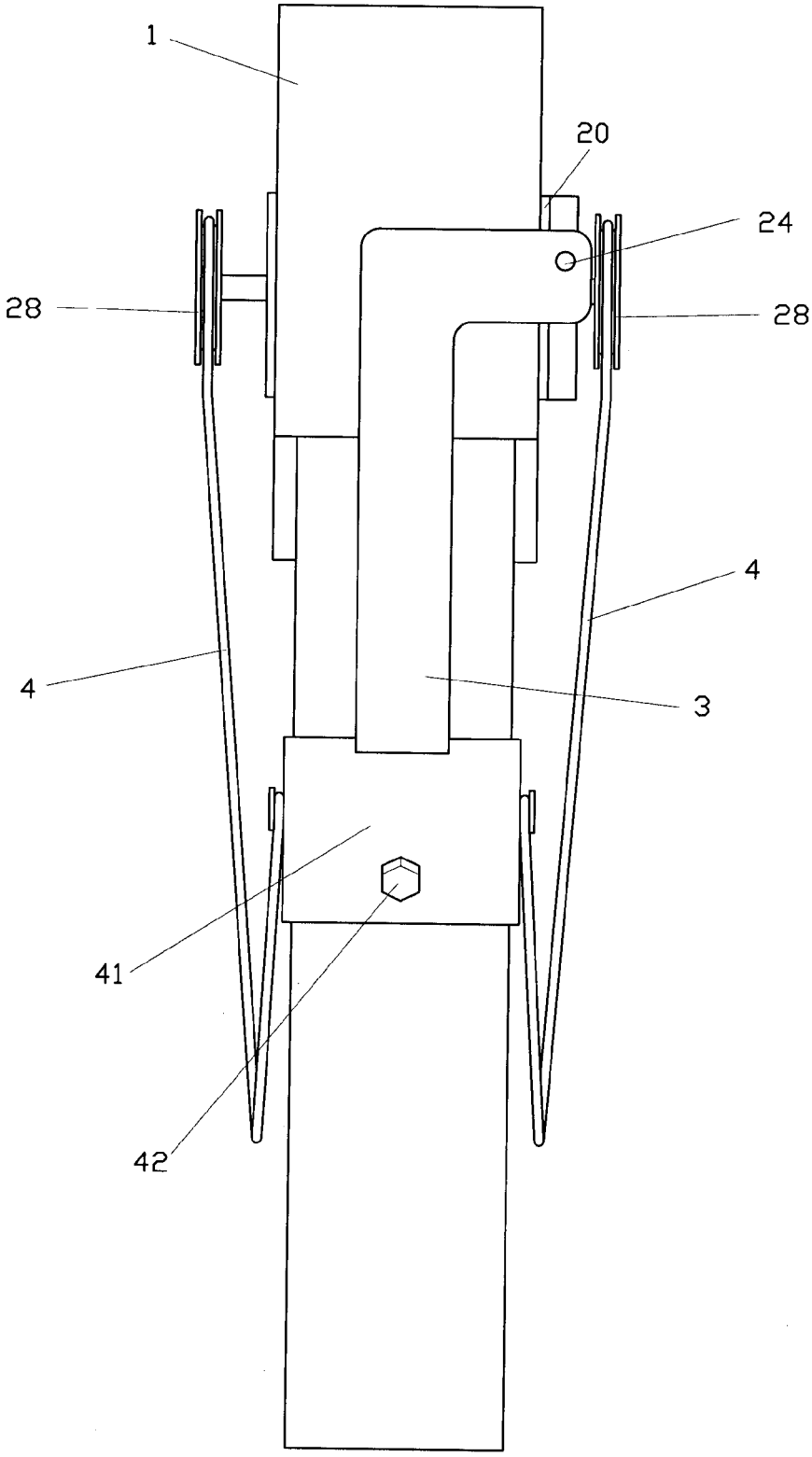
FIG. 2 is a front view of the present invention.
Figure 3:
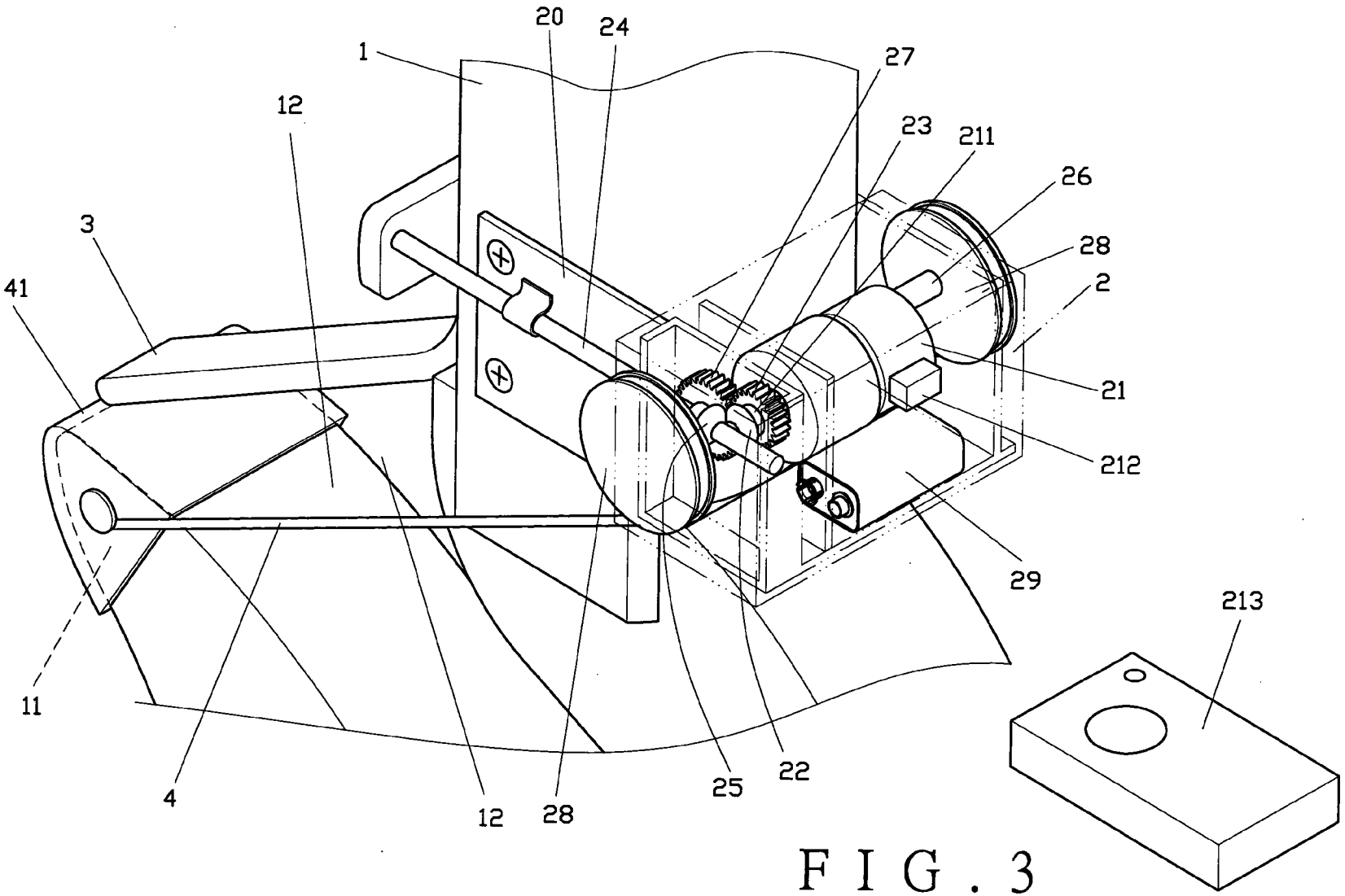
FIG. 3 is an enlarged view of a power unit of the present invention.

As shown in FIGS. 1, 2 and 3, the present invention comprises a hook 1, a power unit 2, a tongue plate 3, and an off-hook member 4.

The hook 1 comprises a hook end 11 with an opening 12.

The power unit 2 is provided with a fixture 20 to be secured to the hook 1 by means of screw, rivet or welding. As shown in FIG. 3, a motor 21 is provided in the power unit 2. The motor 21 may be remote-controlled or equipped with a wire. The motor 21 comprises a shaft 211 and a receiver 212. The receiver 212 is adapted to receive the signal sent from a remote controller 213. A first transmission transforming mechanism 22 and a first gear 23 are provided on the shaft 211. The power unit 2 further comprises a rotating lever 24 and a transmission lever 26. The rotating lever 24 is provided with a second transmission transforming mechanism 25 meshing with the first transmission transforming mechanism 22. The transmission lever 26 is provided with a second gear 27 meshing with the first gear 23. The transmission lever 26 is provided with a pair of transmission wheels 28 at respective ends thereof. The power unit 2 further comprises a power supply unit 29 to provide power to drive the motor 21. The power supply unit 29 may be a battery or an outlet power source.

The tongue plate 3 is fixed to the rotating lever 24 of the power unit 2. The tongue plate 3 is adapted to close or to open the opening 12 of the hook 1.

The off-hook member 4 is a rope or a chain which has a first end and a second end. The first end is fixed and wound on the transmission wheel 28 and the second end is fixed to the hook end 11 of the hook 1. The way to secure the second end of the off-hook member 4 may be done by a sleeve 41, clip, screw, rivet or weld. The sleeve 41 is provided with a screw 42 penetrating the sleeve 41 to secure the hook end 11 of the hook 1. The off-hook member 4 is made of flexible material which may be curved down corresponding to the shape of the hook end 11, as shown in FIG. 1.

Figure 4:
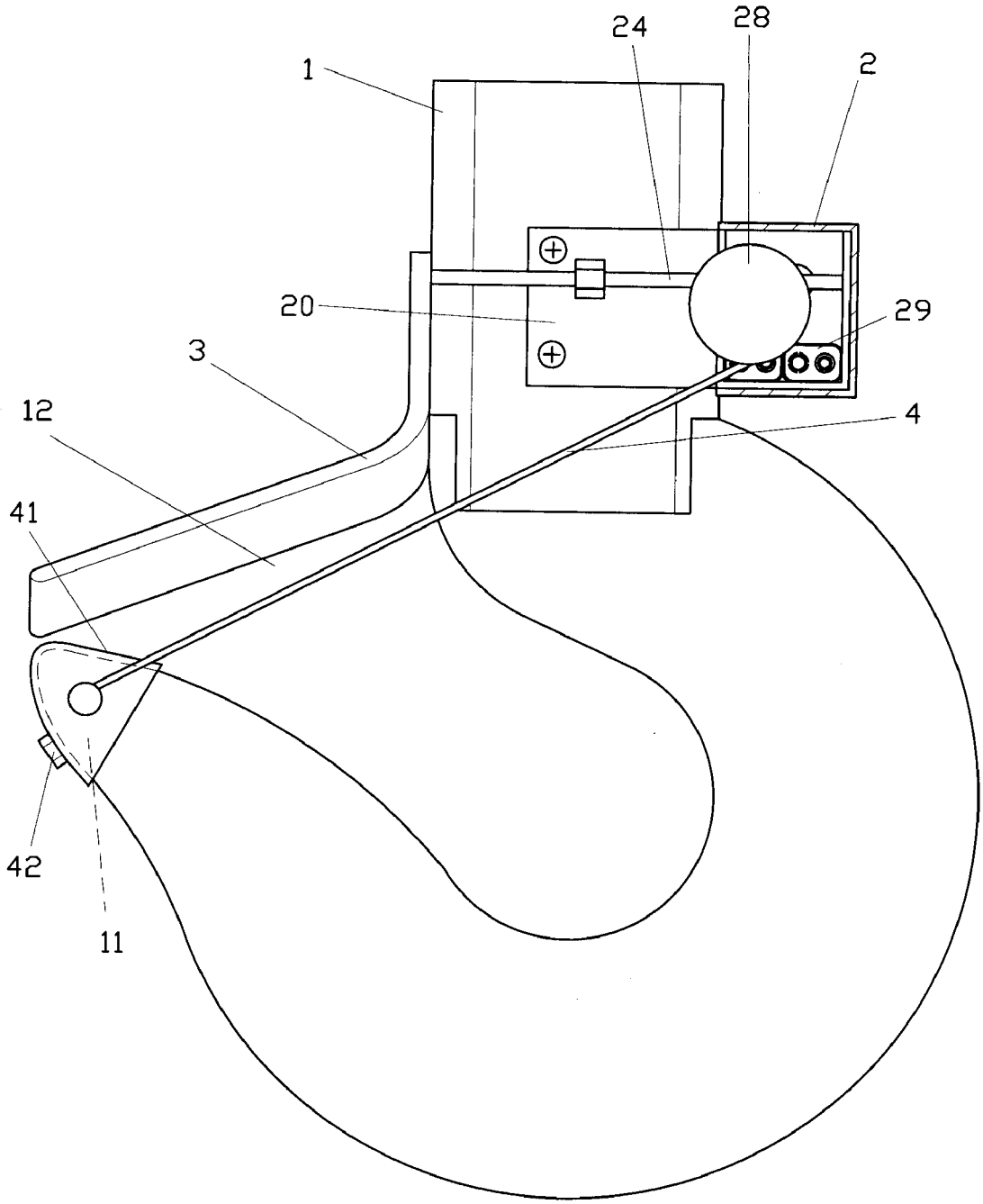
FIG. 4 is a side view of the present invention showing that a tongue plate is rotated and an off-hook member is in a tightened status.
Figure 5:
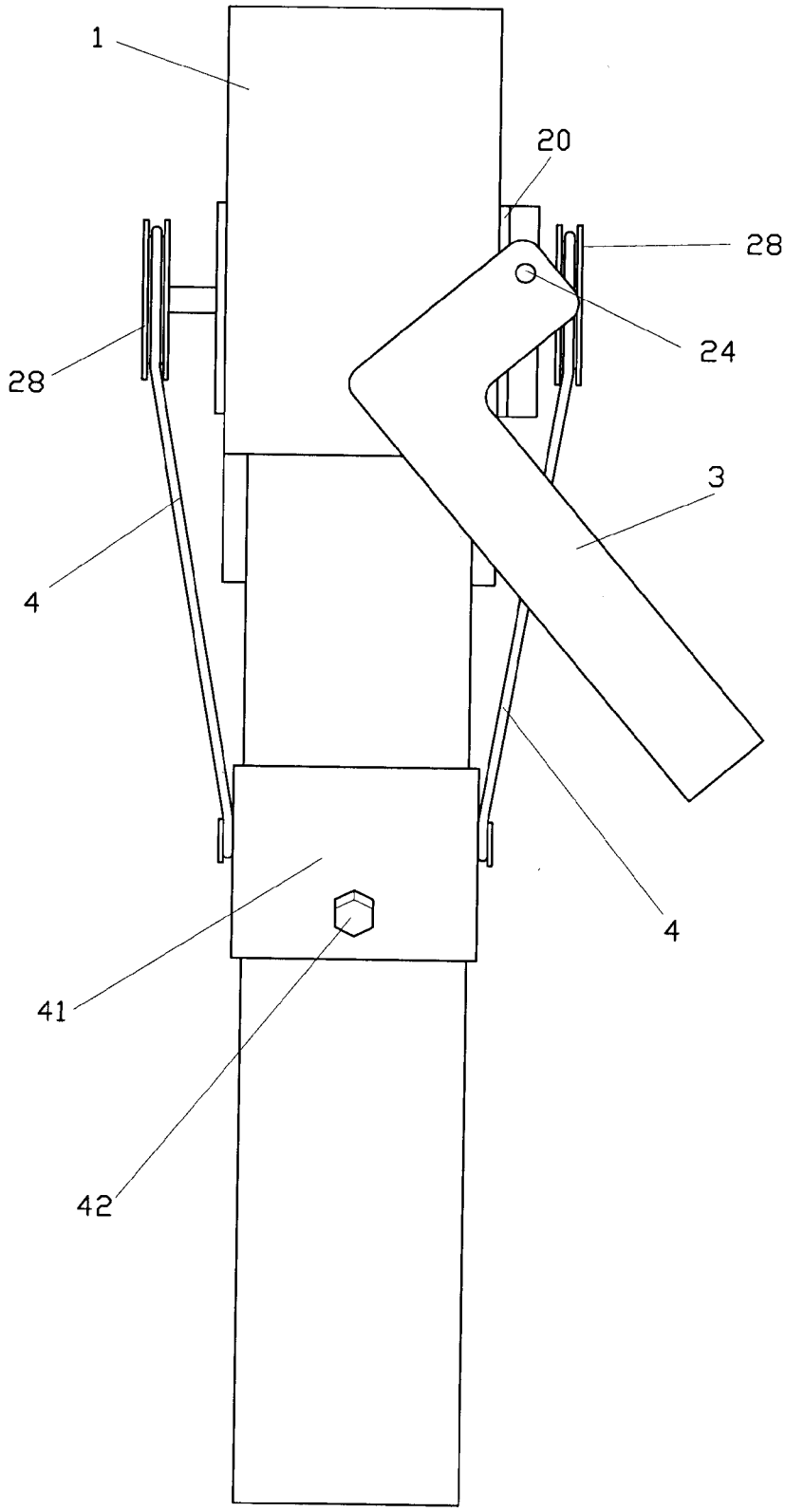
FIG. 5 is a front view of the present invention showing that a tongue plate is rotated and an off-hook member is in a tightened status.

To operate the present invention, as shown in FIGS. 3, 4, and 5, when it is necessary to carry a cargo with a rope A, the remote controller 213 will send a signal to the receiver 212 to activate the motor 21 to rotate. The power supply unit 29 provides the power to drive the motor 21. The shaft 211 of the motor 21 links the first transmission transforming mechanism 22 and the first gear 23 to rotate, as shown in FIG. 3. The rotation of the first transmission transforming mechanism 22 and the first gear 23 links the second transmission transforming mechanism 25 and the second gear 27 to rotate simultaneously. The rotating lever 24 and the transmission lever 26 are also linked to rotate. The tongue plate 27 is linked by the rotating lever 24 to disengage from the hook end 11 of the hook 1, thus the opening 12 is in an open status. The transmission wheels 28 on the transmission lever 26 are also linked to rotate to tighten the off-hook member 4, which makes the off-hook member 4 in a slope status.

Figure 6:
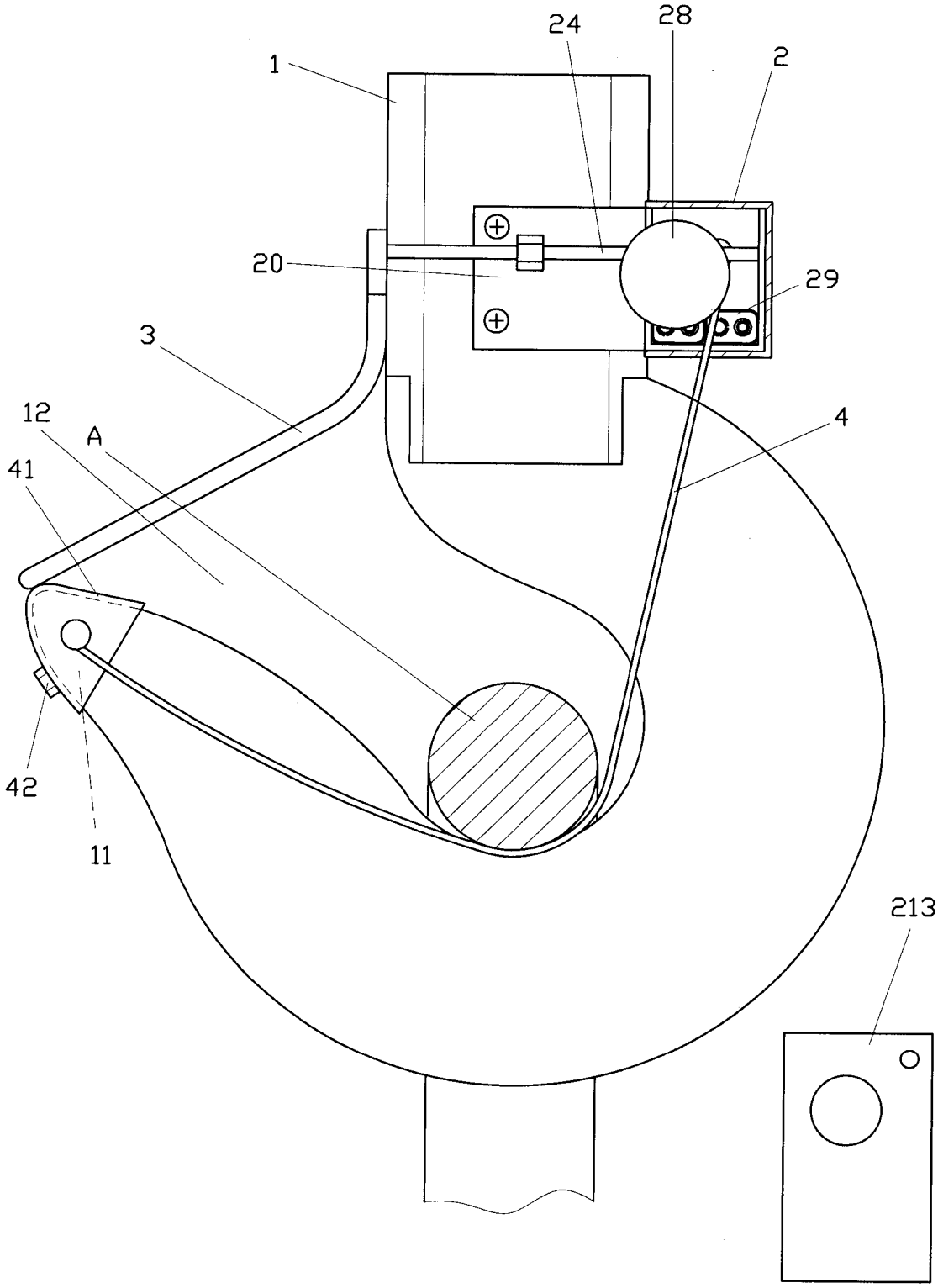
FIG. 6 is a side view of the present invention loading a cargo.

When the cargo is hooked to the hook end 11 of the hook 1, as shown in FIGS. 3 and 6, the remote controller 213 will send a signal to the receiver 212 to activate the motor 21 to rotate reversely. The first transmission transforming mechanism 22 and the first gear 23 link the second transmission transforming mechanism 25 and the second gear 27 to rotate reversely as well. The rotating lever 24 and the transmission lever 26 are also linked to rotate reversely, which brings the tongue plate 3 to engage with the hook end 11 of the hook 1 so that the opening 12 of the hook 1 is in a closed status, while the reversed rotation of the transmission wheels 28 releases the off-hook member 4, thus the cargo may be hooked by the hook end 11 of the hook 1 for carriage.

Figure 7:
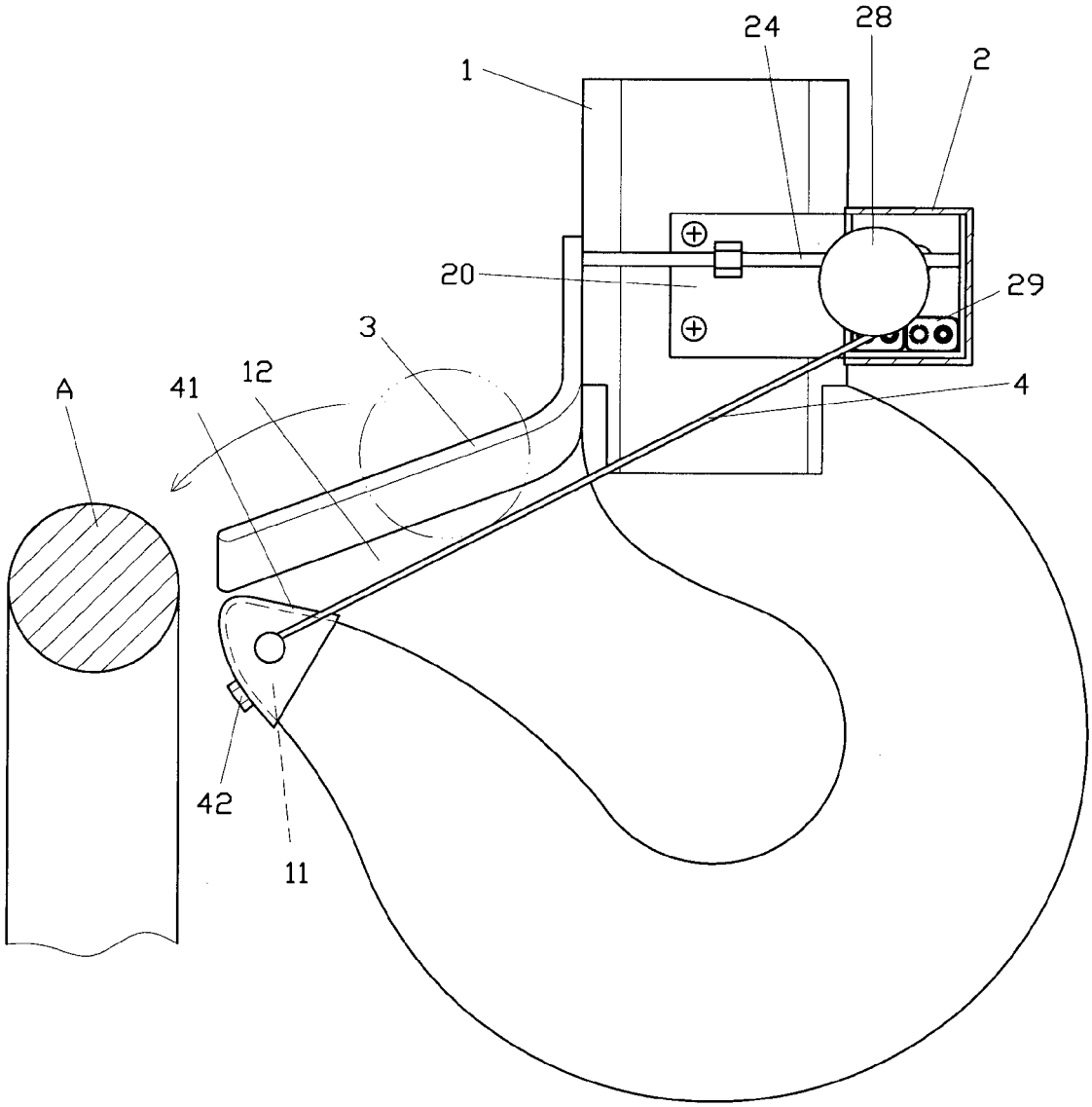
FIG. 7 is a side view of the present invention unloading the cargo.

When the conveyance of the cargo is done, as shown in FIGS. 3 and 7, the remote controller 213 will send a signal to the receiver 212 to activate the motor 21. The shaft 211 links the first transmission transforming mechanism 22 and the first gear 23 to rotate, which links the second transmission transforming mechanism 25 and the second gear 27 to rotate, and then the rotating lever 24, and the transmission lever 26 to rotate. The rotation of the rotating lever 24 links the tongue plate 3 to rotate and to disengage from the hook end 11. The opening 12 of the hook 1 is in an open status. The rotation of the transmission wheels 28 tightens the off-hook member 4 in a slope status, which pulls the rope A upward. The slanting position of the off-hook unit 4 assists the rope A to slide from the hook end 11 of the hook 1 and drop through the opening 12, thus the cargo is off-hook automatically.

What is claimed is:

1. An automatic detaching structure for a hook device, comprising a hook, a power unit, a tongue plate and an off-hook member, wherein said hook having a hook end and an opening and said tongue plate corresponding to said opening of said hook; and characterized by:

said power unit being disposed on said hook and comprising a motor, a rotating lever, a transmission lever, and a pair of transmission wheels at respective ends of said transmission lever;

said tongue plate being secured to said rotating lever of said power unit and driven by said rotating lever to close or to open said opening of said hook; and said off-hook member having a first end and a second end, said first end being fixed to said transmission wheel, said second end being fixed to said hook end of said hook.

2. The automatic detaching structure for a hook device, as recited in claim 1, wherein said power unit is provided with a fixture to be secured to said hook, said motor of said power unit being remote-controlled, said motor comprising a shaft and a receiver, said receiver receiving a signal sent from a remote controller, a first transmission transforming mechanism and a first gear being provided on said shaft, a second transmission transforming mechanism being provided on said rotating lever, a second gear being provided on said transmission lever, said second transmission transforming mechanism meshing with said first transmission transforming mechanism, said second gear meshing with said first gear, said off-hook member being either of a rope and a chain, said off-hook member being provided with a sleeve and a screw penetrating said sleeve, said power unit being operated to pull said off-hook member to change its shape from arc to straight, said power unit further comprising a power supply unit.

3. The automatic detaching structure for a hook device, as recited in claim 2, wherein said power supply unit is a battery.

4. The automatic detaching structure for a hook device, as recited in claim 2, wherein said power supply unit is an outlet power supply.

* * * * *